US011857028B2

(12) United States Patent
Dombrow et al.

(10) Patent No.: US 11,857,028 B2
(45) Date of Patent: Jan. 2, 2024

(54) FOOTWEAR INCLUDING AN ADAPTABLE AND ADJUSTABLE LACING SYSTEM

(71) Applicant: Under Armour, Inc., Baltimore, MD (US)

(72) Inventors: David Dombrow, Baltimore, MD (US); Kevin Fallon, Portland, OR (US); Tom White, Ruxton, MD (US)

(73) Assignee: Under Armour, Inc., Baltimore, MD (US)

( * ) Notice: Subject to any disclaimer, the term of this patent is extended or adjusted under 35 U.S.C. 154(b) by 261 days.

(21) Appl. No.: 17/014,122

(22) Filed: Sep. 8, 2020

(65) Prior Publication Data

US 2020/0397095 A1 Dec. 24, 2020

Related U.S. Application Data

(63) Continuation of application No. 15/147,943, filed on May 6, 2016, now abandoned.

(Continued)

(51) Int. Cl.
*A43B 23/02* (2006.01)
*A43C 1/04* (2006.01)

(Continued)

(52) U.S. Cl.
CPC ..... *A43B 23/028* (2013.01); *A43B 1/04* (2013.01); *A43B 5/06* (2013.01); *A43B 7/085* (2013.01);

(Continued)

(58) Field of Classification Search
CPC ..... A43C 1/04; A43C 5/00; A43C 11/008
See application file for complete search history.

(56) References Cited

U.S. PATENT DOCUMENTS

X371394 10/1887 Warren
625,331 A 5/1899 Daut (Continued)

FOREIGN PATENT DOCUMENTS

EP 0632972 B1 9/1996
EP 1130146 A4 9/2004

(Continued)

OTHER PUBLICATIONS

"Thermal Conductivity of some common Materials and Gases", XP055185305, downloaded from https://web.archive.org/web/2015031804 3824/http://www.engineeringtoolbox.com/thermal-conductivity-d_429.html, obtained Apr. 23, 2015, 11 pages.

(Continued)

*Primary Examiner* — Jocelyn Bravo
(74) *Attorney, Agent, or Firm* — Edell, Shapiro & Finnan, LLC

(57) ABSTRACT

An article of footwear includes an upper and an adjustable lacing system. The adjustable lacing system includes a plurality of fastener engaging elements located at the medial and lateral sides of the upper, where at least one of the medial side and the lateral side includes sets of fastener engaging elements. Each set of fastener engaging elements is distanced from another set in a direction transverse a lengthwise direction of the upper, and the fastener engaging elements are configured to engage with and retain a fastener structure that extends between the medial and lateral sides of the upper such that the fastener structure can be selectively engaged with different sets of fastener engaging elements to adjust a fit of the upper around a width of the foot disposed within the cavity.

14 Claims, 10 Drawing Sheets

Related U.S. Application Data

(60) Provisional application No. 62/158,709, filed on May 8, 2015.

(51) Int. Cl.

| | |
|---|---|
| ***A43B 1/04*** | (2022.01) |
| ***A43C 1/00*** | (2006.01) |
| ***A43B 7/08*** | (2022.01) |
| ***D04B 1/16*** | (2006.01) |
| ***A43B 23/08*** | (2006.01) |
| ***D04B 1/24*** | (2006.01) |
| ***D04B 1/14*** | (2006.01) |
| ***A43B 5/06*** | (2022.01) |
| ***D04B 1/12*** | (2006.01) |
| ***D04B 1/22*** | (2006.01) |

(52) U.S. Cl.

CPC ..... *A43B 23/02* (2013.01); *A43B 23/0205* (2013.01); *A43B 23/0235* (2013.01); *A43B 23/0255* (2013.01); *A43B 23/0275* (2013.01); *A43B 23/086* (2013.01); *A43C 1/00* (2013.01); *A43C 1/04* (2013.01); *D04B 1/123* (2013.01); *D04B 1/14* (2013.01); *D04B 1/16* (2013.01); *D04B 1/22* (2013.01); *D04B 1/24* (2013.01); *D10B 2401/041* (2013.01); *D10B 2403/02* (2013.01); *D10B 2501/043* (2013.01)

(56) References Cited

U.S. PATENT DOCUMENTS

| | | | | |
|---|---|---|---|---|
| X712003 | | 10/1902 | Payne | |
| X716528 | | 12/1902 | Flowers et al. | |
| X913012 | | 2/1909 | Jackson | |
| X914406 | | 3/1909 | Gardner | |
| 1,309,271 | A | 7/1919 | Zapis | |
| 1,697,893 | A | 1/1929 | Winlow | |
| 1,862,047 | A | 6/1932 | Boulet et al. | |
| RE18,804 | E | 4/1933 | Joha | |
| D90,369 | S | 7/1933 | Ludwick | |
| 2,147,197 | A | 2/1939 | Glidden | |
| 2,230,915 | A | 2/1941 | Spiro | |
| 2,314,098 | A | 3/1943 | McDonald | |
| 2,334,659 | A | 11/1943 | Van Arsdale et al. | |
| 2,335,210 | A | 11/1943 | Guinzberg | |
| 2,345,055 | A | 3/1944 | Lilley et al. | |
| 2,345,057 | A | 3/1944 | Marinetti | |
| 2,369,254 | A | 2/1945 | Roman | |
| 2,400,692 | A | 5/1946 | Herbert | |
| 2,420,239 | A | 5/1947 | Hack | |
| 2,440,393 | A | 4/1948 | Clark | |
| 2,467,237 | A | 4/1949 | Sherman et al. | |
| 2,495,984 | A | 1/1950 | Roy | |
| 2,538,673 | A | 1/1951 | Donahue | |
| 2,586,045 | A | 2/1952 | Hoza | |
| 2,636,287 | A | 4/1953 | Heilbronner | |
| 2,641,004 | A | 6/1953 | Whiting et al. | |
| 2,675,631 | A | 4/1954 | Doughty | |
| 2,679,117 | A | 5/1954 | Reed | |
| 3,093,916 | A | 6/1963 | Hiestand et al. | |
| 3,546,796 | A | 12/1970 | Adams | |
| 3,703,775 | A | 11/1972 | Gatti | |
| 3,925,912 | A | 12/1975 | Martineau | |
| 4,232,458 | A | 11/1980 | Bartels | |
| 4,245,408 | A | 1/1981 | Larsen et al. | |
| 4,255,876 | A | 3/1981 | Johnson | |
| 4,559,723 | A | 12/1985 | Hamy et al. | |
| 4,670,949 | A | 6/1987 | Autry | |
| D292,941 | S | 12/1987 | Kelley | |
| 4,756,098 | A | 7/1988 | Boggia | |
| 4,785,558 | A | 11/1988 | Shiomura | |
| 4,870,761 | A | 10/1989 | Tracy | |
| D309,822 | S | 8/1990 | Barret | |
| 4,958,418 | A | 9/1990 | Dufour | |
| 5,016,327 | A * | 5/1991 | Klausner | A43C 7/00 24/713.3 |
| 5,042,120 | A | 8/1991 | Nichols | |
| 5,086,576 | A | 2/1992 | Lamson | |
| 5,181,331 | A | 1/1993 | Berger | |
| 5,184,378 | A | 2/1993 | Batra | |
| 5,271,130 | A | 12/1993 | Batra | |
| 5,282,846 | A | 2/1994 | Schmitt | |
| 5,345,638 | A | 9/1994 | Nishida | |
| 5,365,677 | A | 11/1994 | Dalhgren | |
| 5,371,957 | A | 12/1994 | Gaudio | |
| 5,377,430 | A | 1/1995 | Hatfield et al. | |
| D375,617 | S | 11/1996 | Orzeck | |
| D377,414 | S | 1/1997 | Hatfield | |
| 5,692,319 | A | 12/1997 | Parker et al. | |
| 5,692,320 | A | 12/1997 | Nichols | |
| 5,700,573 | A | 12/1997 | McCullough | |
| 5,784,806 | A | 7/1998 | Wendt | |
| 5,965,223 | A | 10/1999 | Andrews et al. | |
| 6,052,921 | A | 4/2000 | Oreck | |
| D428,239 | S | 7/2000 | Plamondon | |
| 6,108,943 | A | 8/2000 | Hudson et al. | |
| D438,697 | S | 3/2001 | Matis | |
| D444,624 | S | 7/2001 | Wilson | |
| D447,858 | S | 9/2001 | Matis | |
| 6,298,582 | B1 | 10/2001 | Friton et al. | |
| D458,015 | S | 6/2002 | Dolan | |
| 6,401,364 | B1 | 6/2002 | Burt | |
| 6,449,879 | B1 * | 9/2002 | Fallon | A43B 5/02 36/50.1 |
| D494,353 | S | 8/2004 | McDowell | |
| 6,880,268 | B2 | 4/2005 | Chen | |
| 6,910,288 | B2 | 6/2005 | Dua | |
| 6,931,762 | B1 | 8/2005 | Dua | |
| 6,986,269 | B2 | 1/2006 | Dua | |
| D520,225 | S | 5/2006 | Choi | |
| D521,226 | S | 5/2006 | Douglas | |
| 7,051,460 | B2 | 5/2006 | Orei et al. | |
| D526,771 | S | 8/2006 | Fallon | |
| 7,131,296 | B2 | 11/2006 | Dua et al. | |
| D545,557 | S | 7/2007 | Caine | |
| D549,441 | S | 8/2007 | Chang | |
| D551,841 | S | 10/2007 | Choi | |
| 7,325,337 | B2 * | 2/2008 | Cox | A43B 1/0027 36/100 |
| 7,338,877 | B1 | 3/2008 | Meyer | |
| 7,347,011 | B2 | 3/2008 | Dua et al. | |
| D572,453 | S | 7/2008 | Alfaro | |
| D574,591 | S | 8/2008 | Belley | |
| D578,294 | S | 10/2008 | Mervar | |
| 7,624,517 | B2 | 12/2009 | Smith | |
| 7,627,963 | B2 | 12/2009 | Kilgore | |
| 7,634,861 | B2 | 12/2009 | Kilgore | |
| 7,637,032 | B2 | 12/2009 | Sokolowski et al. | |
| 7,774,956 | B2 | 8/2010 | Dua et al. | |
| D624,297 | S | 9/2010 | Henderson | |
| 7,793,436 | B2 | 9/2010 | Sink | |
| 7,814,598 | B2 | 10/2010 | Dua et al. | |
| 7,823,298 | B2 | 11/2010 | Nishiwaki et al. | |
| D636,569 | S | 4/2011 | McMillan | |
| D636,584 | S | 4/2011 | Williams, Jr. | |
| D639,543 | S | 6/2011 | Lamont | |
| 8,028,440 | B2 | 10/2011 | Sokolowski et al. | |
| 8,042,288 | B2 | 10/2011 | Dua et al. | |
| D661,884 | S | 6/2012 | Raysse | |
| 8,209,883 | B2 | 7/2012 | Lyden | |
| 8,215,132 | B2 | 7/2012 | Dua et al. | |
| 8,266,749 | B2 | 9/2012 | Dua et al. | |
| 8,272,148 | B2 | 9/2012 | Nishiwaki et al. | |
| D668,858 | S | 10/2012 | Shaffer | |
| 8,418,380 | B2 * | 4/2013 | Dojan | A43B 5/06 36/47 |
| 8,448,474 | B1 | 5/2013 | Tatler et al. | |
| 8,590,345 | B2 | 11/2013 | Sokolowski et al. | |
| 8,595,878 | B2 | 12/2013 | Huffa et al. | |
| 8,621,891 | B2 | 1/2014 | Dua et al. | |
| 8,650,916 | B2 | 2/2014 | Dua et al. | |
| 8,701,232 | B1 | 4/2014 | Droege et al. | |
| D707,436 | S | 6/2014 | Seamarks | |

(56) References Cited

U.S. PATENT DOCUMENTS

D707,943 S 7/2014 Nascimento
D707,947 S 7/2014 Seamarks
D709,280 S 7/2014 Shaffer
8,800,172 B2 8/2014 Dua
8,839,532 B2 9/2014 Huffa et al.
8,881,430 B2 11/2014 Seamarks et al.
8,898,931 B2 12/2014 Gerber
D722,226 S 2/2015 Williams, Jr.
8,950,088 B2 2/2015 Aveni et al.
8,959,959 B1 2/2015 Podhajny
8,973,288 B2 3/2015 Dojan et al.
8,973,410 B1 3/2015 Podhajny
8,997,529 B1 4/2015 Podhajny
9,032,763 B2 5/2015 Meir et al.
D731,765 S 6/2015 Opie
9,060,562 B2 6/2015 Meir et al.
D735,465 S 8/2015 Petrie
D737,552 S 9/2015 Guichot
D738,085 S 9/2015 Kirschner
D738,089 S 9/2015 Avar
9,149,086 B2 10/2015 Greene et al.
9,150,986 B2 10/2015 Dua et al.
9,192,204 B1 11/2015 Liles et al.
D748,389 S 2/2016 Small
D753,376 S 4/2016 Birkinhead
9,404,205 B2 8/2016 Meir
D765,964 S 9/2016 Fallon
D772,553 S 11/2016 Williams, Jr.
9,491,987 B2 11/2016 Antonelli et al.
9,510,637 B2 12/2016 Podhajny et al.
9,578,928 B2 2/2017 Farris
2002/0010988 A1 1/2002 Cretinon
2002/0104233 A1* 8/2002 Fallon ..... A43C 11/20 36/50.1
2002/0166260 A1 11/2002 Borsoi
2004/0118018 A1 6/2004 Dua et al.
2004/0181972 A1 9/2004 Csorba
2005/0022427 A1* 2/2005 Kerns ..... A43C 11/16 36/50.1
2005/0193592 A1 9/2005 Dua et al.
2005/0198866 A1 9/2005 Wiper et al.
2006/0053658 A1 3/2006 Voughiohn
2007/0068041 A1 3/2007 Farys
2008/0110048 A1* 5/2008 Dua ..... A43B 3/0031 12/146 C
2009/0100717 A1 4/2009 Cabanis
2009/0126231 A1 5/2009 Malmivaara
2009/0277043 A1 11/2009 Graser et al.
2010/0051132 A1 3/2010 Glenn
2010/0064547 A1* 3/2010 Kaplan ..... A43C 1/04 36/50.1
2010/0107443 A1 5/2010 Aveni
2010/0154256 A1* 6/2010 Dua ..... D04B 1/16 12/146 B
2011/0003524 A1 1/2011 Claasen
2011/0041232 A1 2/2011 Covelli
2011/0113648 A1 5/2011 Leick et al.
2011/0225843 A1 9/2011 Kerns et al.
2011/0283435 A1 11/2011 Smith
2012/0174437 A1* 7/2012 Heard ..... A43C 1/04 36/50.1
2012/0246973 A1* 10/2012 Dua ..... A43B 23/0255 36/83
2012/0255201 A1* 10/2012 Little ..... A43D 111/00 12/142 R
2013/0019501 A1 1/2013 Gerber
2013/0318837 A1 12/2013 Dua et al.
2014/0130372 A1 5/2014 Aveni et al.
2014/0137434 A1* 5/2014 Craig ..... A43B 23/0245 66/170
2014/0150295 A1 6/2014 Dua et al.
2014/0196311 A1 7/2014 Follet
2014/0223779 A1 8/2014 Elder et al.
2014/0237861 A1 8/2014 Podhajny
2014/0325873 A1 11/2014 Linth
2014/0360050 A1 12/2014 Kohatsu et al.
2015/0013080 A1 1/2015 Thomas et al.
2015/0013187 A1 1/2015 Taniguchi et al.
2015/0033519 A1 2/2015 Hammerslag et al.
2015/0047227 A1 2/2015 Fallon et al.
2015/0059211 A1 3/2015 Droege et al.
2015/0107307 A1 4/2015 Kosui et al.
2015/0216255 A1 8/2015 Podhajny
2015/0216256 A1 8/2015 Podhajny
2016/0095387 A1 4/2016 Follet et al.
2016/0128428 A1* 5/2016 Ikenaka ..... A43B 23/08 12/146 C
2016/0286903 A1 10/2016 Whewell et al.
2016/0302524 A1* 10/2016 Smith ..... A43B 13/12
2016/0331084 A1 11/2016 Xanthos et al.
2017/0065028 A1 3/2017 Foster et al.
2017/0065029 A1 3/2017 Bordin
2017/0105487 A1 4/2017 Klein
2017/0105489 A1 4/2017 Lovett
2017/0135435 A1* 5/2017 Ikenaka ..... A43B 1/04
2018/0110283 A1 4/2018 Brinkman et al.

FOREIGN PATENT DOCUMENTS

EP 2792260 A3 12/2014
EP 2792264 A3 12/2014
EP 2792265 A3 12/2014
EP 2149629 B1 1/2015
GB 0012787 B2 6/1904

OTHER PUBLICATIONS

Supplementary European Search Report, EP16793231, date of completion Dec. 11, 2018, 8 pages.
"Thermal Conductivity of some common Materials and Gases", (The Engineering Toolbox) Jan. 7, 2015; https://web.archive.org/web/20150107151233/http://www.engineeringtoolvbox.com/thermal-conductivity-d_429, pp. 2-3.
Written Opinion and International Search Report from Related PCT Application No. PCT/US2016/031093, dated Aug. 31, 2016.

* cited by examiner

FOOTWEAR INCLUDING AN ADAPTABLE AND ADJUSTABLE LACING SYSTEM

The present application is a continuation of U.S. patent application Ser. No. 15/147,943, filed May 6, 2016, and entitled "Footwear Including an Adaptable and Adjustable Lacing System", which claims priority to U.S. Provisional Application No. 62/158,709 filed May 8, 2015 and entitled "Footwear Including a Textile Upper". The disclosures of the aforementioned applications are incorporated herein by reference in their entireties.

FIELD OF THE INVENTION

Background

Articles of footwear typically include an upper and a sole structure attached to the upper. A variety of different materials can be used to form the upper. Athletic footwear, for example, often includes an upper having textiles that are stitched or adhesively bonded to a foam layer. Similarly, hiking boots and work boots often include a durable outer shell formed of leather and an inner lining formed of a textile joined with foam materials. Footwear uppers formed from textiles are generally lightweight and flexible structures designed to provide comfort to the user and provide other desirable features. Other materials, such as leather, synthetic leather, rubber and/or other components can also be incorporated with a textile to form an upper having desirable aesthetic and functional features that incorporate durability, flexibility, air permeability and/or other types of desirable properties to the upper. Providing such features in an upper, however, can increase the complexities associated with manufacture of the upper. Furthermore, the incorporation of materials such as leather or rubber into the upper to increase the strength and durability of the upper can also incorporate other undesirable properties into the upper, such as a reduction in air permeability of the upper resulting in trapping of moisture (e.g., perspiration) within the upper during use.

A lacing system for an article of footwear is typically integrated (at least partially) with the upper to provide a snug and comfortable fit of the upper around the foot of the wearer. However, the lacing system can be limited based upon the size of the upper in relation to the wearer's foot. In addition, it can be difficult to suitably characterize a shoe size for all different foot sizes. While conventional shoe sizes take into consideration heel-to-toe length and foot girth or width, such length and width dimensions are typically standardized and cannot accommodate all possible variations of foot sizes.

Accordingly, it would be desirable to provide a textile upper for footwear that is lightweight, breathable, and durable and further includes a lacing system that is adjustable to accommodate and provide a snug yet comfortable fit for a variety of different foot sizes.

SUMMARY OF THE INVENTION

In an example embodiment, an article of footwear comprises an upper including a heel section, a vamp, a toe cage, a lateral side and a medial side, where the upper defines a cavity to receive a foot that is defined between the heel section, the vamp, the toe cage and the medial and lateral sides. An adaptable and adjustable lacing system is also provided that comprises a plurality of fastener engaging elements located at the medial side and the lateral side, where at least one of the medial side and the lateral side includes sets of fastener engaging elements. Each set of fastener engaging elements is distanced from another set in a direction transverse a lengthwise direction of the upper. The fastener engaging elements are further configured to engage with and retain a fastener structure that extends between the medial and lateral sides of the upper such that the fastener structure can be selectively engaged with different sets of fastener engaging elements to adjust a fit of the upper around a width of the foot disposed within the cavity.

In another example embodiment, an article of footwear comprises an upper including a heel section, a vamp, a toe cage, a lateral side and a medial side, wherein the upper defines a cavity to receive a foot that is defined between the heel section, the vamp, the toe cage and the medial and lateral sides. An adjustable lacing system is also provided that comprises a first connection configuration located at one of the medial and lateral sides, where the first connection configuration engages a fastener structure so as to position at least one portion of the fastener structure exterior to the cavity of the upper. The adjustable lacing system further comprises a second connection configuration located at the other of the medial and lateral sides, where the second connection configuration engages the fastener structure so as to position at least another portion of the fastener structure within the cavity of the upper. The adjustable lacing system facilitates selective engagement of the fastener structure with different sets of fastener engaging elements of at least one of the first and second connection configurations so as to adjust a fit of the upper around a width of the foot disposed within the cavity.

In the embodiments, the article of footwear can include an instep cover that is integral with one of the medial and lateral sides and includes a free end, where the instep cover is suitably dimensioned to extend toward the other of the medial and lateral sides such that at least the free end of the instep cover extends within the cavity defined by the upper.

The article of footwear can further include a sole structure connected with the upper.

The above and still further features and advantages of embodiments of the present invention will become apparent upon consideration of the following detailed description thereof, particularly when taken in conjunction with the accompanying drawings wherein like reference numerals in the various figures are utilized to designate like components.

BRIEF DESCRIPTION OF THE DRAWINGS

Like reference numerals have been used to identify like elements throughout this disclosure.

DETAILED DESCRIPTION

Figure 1:
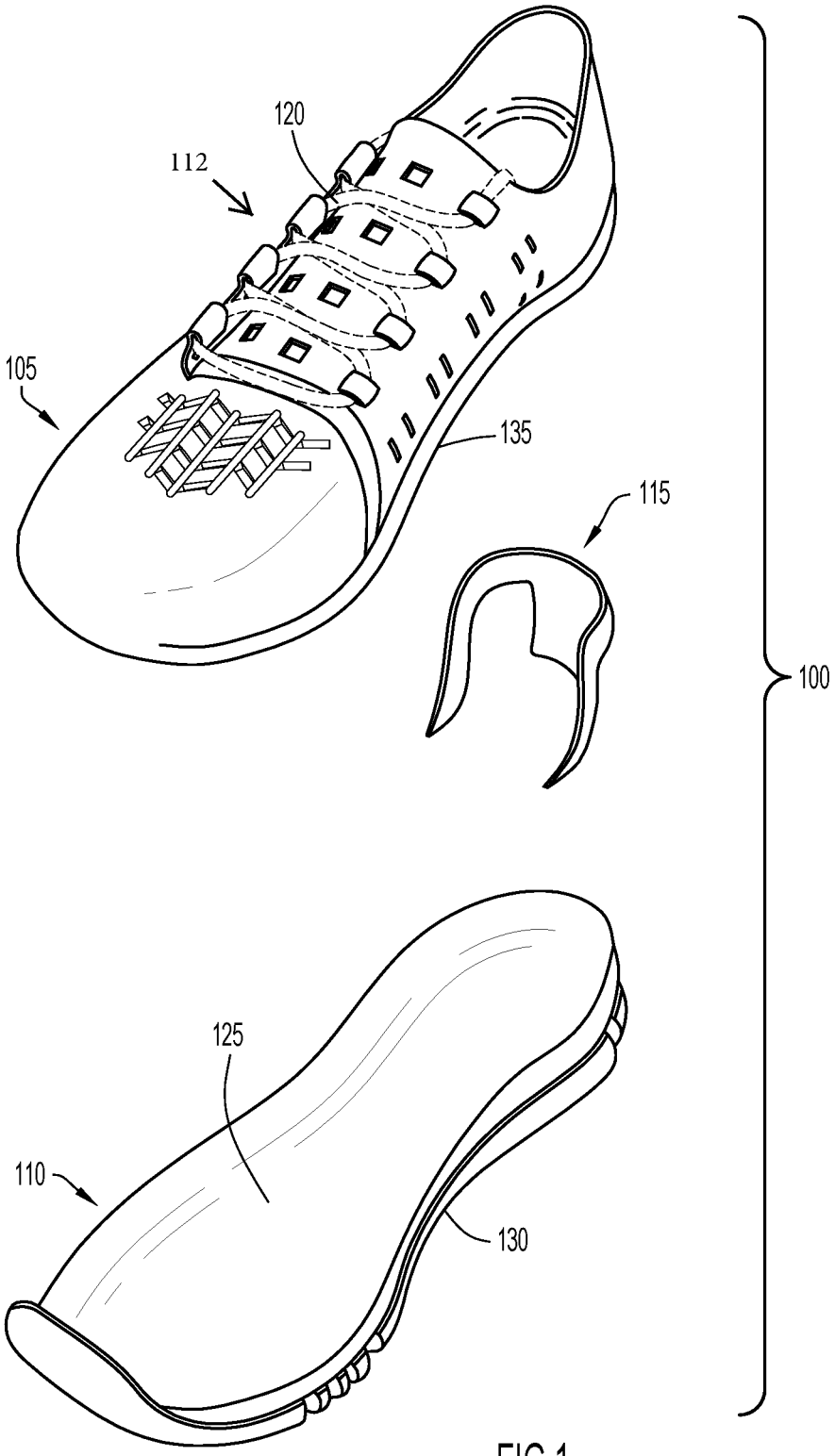
FIG. 1 is an exploded view of an article of footwear in accordance with an embodiment of the invention.

As described herein with reference to the example embodiment of FIG. 1, an article of footwear 100 in accordance with the invention includes an upper 105 coupled to a sole structure 110 and further including a heel counter 115 and an adjustable lacing system 112 configured to engage with a fastening element or fastener 120 (e.g., a shoe lace or cord, which is shown in phantom) as described herein. The upper 105 is a textile which can be formed as a single or unitary structure (also called a unitary member) as shown in the figures and having a minimal number of seams utilized to form the shape of the upper. That is, the upper 105 can be formed as a one-piece structure each portion of which is integral with adjacent portions in a seamless manner. However, it is noted that the adjustable lacing system of the present invention is not limited to footwear including uppers formed as a single or unitary structure but instead can be implemented in footwear including a plurality of individually formed portions that are combined or connected in any suitable manner to form an upper for the footwear. In addition, while the upper as described herein is formed utilizing a knitting process, the adjustable lacing system of the present invention can also be implemented for footwear including an upper formed in any other suitable manner (e.g., via molded textile components).

Knitting is a process for constructing fabric by interlooping one or more yarns. In general, knitting includes warp knitting and weft knitting. In warp knitting, the yarns generally run lengthwise in the fabric (e.g., tricot, milanese, and raschel knitting). In weft knitting, one continuous thread runs crosswise in the fabric making all of the loops in one course. Weft knitting includes both circular knitting and flat knitting. In circular knitting, the fabric is produced on the knitting machine in the form of a tube, with the threads running continuously around the fabric. In flat knitting, the fabric is produced on the knitting machine in flat form, the threads alternating back and forth across the fabric. By way of example, the template is knitted using a programmable CMS 530 H or CMS 730 S flat knitting machine from H. Stoll GmbH & Co. The upper 105 may possess a plaited knit structure, containing an interior layer or face and an exterior layer or face formed of the same or varying strands and or stitches. Both the interior and exterior layers are formed concurrently by knitting a plaited construction so that the layers are distinct, yet integrated one with the other.

The strands forming the textile (e.g., knit) structure may be of any one or more types suitable for the described purpose (to form a shoe upper). The term strand includes a single fiber, filament, or monofilament, as well as an ordered assemblage of textile fibers having a high ratio of length to diameter and normally used as a unit (e.g., slivers, roving, single yarns, plies yarns, cords, braids, ropes, etc.). In a preferred embodiment a strand is a yarn (a continuous strand of textile fibers, filaments, or material in a form suitable for knitting, weaving, or otherwise intertwining to form a textile fabric). A yarn may include a number of fibers twisted together (spun yarn); a number of filaments laid together without twist (a zero-twist yarn); a number of filaments laid together with a degree of twist; and a single filament with or without twist (a monofilament). The strands forming the textile upper 105 can be natural strands (e.g., cotton strands, wool strands, silk strands, etc.) and/or synthetic strands formed of one or more types of polymers, including fibers or filaments having one or more polymer components formed within the fibers or filaments. Examples of materials that may be utilized in the spun staple and/or continuous filament hard yarns include cotton, polyester, nylon, polypropylene, polyethylene, acrylics, wool, acetate, polyacrylonitrile, and combinations thereof. Natural fibers include cellulosic fibers (e.g., cotton, bamboo) or protein fibers (e.g., wool, silk, and soybean).

The strands forming the textile upper 105 may also be formed of and/or include at least one type of polymer component that either softens or melts (becomes molten) when heated to a predetermined temperature. Softening polymers will possess a softening point within a certain desired range. The softening point is the temperature at which a material softens beyond some arbitrary softness (as determined by, e.g., Vicat method). In an embodiment, the softening point of the polymer is from about 60° C. to 90° C. The strands forming the textile upper 105 may be one or more of softening strands (formed of softening polymers), melting strands (formed of melting polymers), and/or non-fusing strands (strands that neither soften nor fuse). Examples of suitable fusing polymer components that can be used to form fusing strands and fusing yarns include, without limitation, thermoplastic materials such as polyurethanes (i.e., thermoplastic polyurethane or TPU), polyesters (e.g., polyethylene terephthalate), polyolefins (e.g., polyethylene and polypropylene), and polyamides (e.g., aliphatic polyamides such as Nylon), and any suitable combinations or copolymers thereof.

With fusing strands, the melting of the polymer results in the fusion of a portion of the fusing strand to one or more adjacent strands within the textile upper 105 (e.g., due to the molten polymer component of the fusing strand surrounding an adjacent strand and/or intermingling with a molten polymer component of the adjacent strand). Fusing strands secure the loops of the knit in place. Specifically, when an appropriate amount of heat (wet or dry) is applied to the textile structure, the fusing strands flow to adjacent strands. Upon cooling, the fusing strands anchor adjacent loops to each other. This not only alters the elasticity of a given area of the upper, but also reinforces the area, adding rigidity thereto. With this configuration, it is possible to control the elasticity and/or rigidity of the upper by controlling the amount of fusing strands within the textile structure. Inserting a greater amount of fusing strand (e.g., placing every three course) provides greater rigidity and less elasticity to the upper than inserting a lower amount of fusing strand (e.g., placing every 10 courses). In example embodiments, the textile structure includes fusing strands in different portions of the upper to achieve different degrees of elasticity, including providing suitable features of elasticity within the upper to facilitate effective operation of the adjustable lacing system as described herein.

A non-fusing polymer refers to any polymer component that possesses a softening, glass transition, or melting point greater than that of any softening or fusing strands present in the textile structure and/or greater than the temperature ranges specified above. Accordingly, a non-fusing strand refers to a strand that does not include any fusing polymer component, while a non-fusing yarn refers to a yarn that does not include any fusing strand. By way of example, non-fusing strands includes strands with one or more non-fusing polymer components and/or strands comprising naturally occurring fibers or filaments (e.g., wool, cotton, silk, etc.). Non-fusing polymer components can include both thermosetting polymers and thermoplastic polymers with melting points (or temperature points at which at least some of the polymer components begin to soften and/or melt) greater than fusing polymer components. Examples of suitable non-fusing polymer components that can be used to form non-fusing strands and non-fusing yarns for forming the textile upper 105 include, without limitation, polyurethanes, polyesters (e.g., polyethylene terephthalate), polyolefins (e.g., polyethylene and polypropylene), polyamides, elastomers and any suitable combinations or copolymers thereof.

The strands, in addition to being fusing, non-fusing, or softening, may further be elastic or non-elastic strands. An elastic strand possesses elasticity and/or recovery, i.e., the ability to recover its original size and shape immediately after removal of a stress (i.e., after stretching) causing deformation (the degree to which fibers, yarn, or cord returns to its original size and shape after deformation indicates how well a fabric recovers). An elastic strand, by virtue of its composition, possesses the ability to stretch. Some specific examples of elastic polymer components suitable for forming an elastic strand are, without limitation, elastomeric polyester-polyurethane copolymers such as elastane, which is a manufactured fiber in which the fiber-forming substance is a long chain synthetic polymer composed of at least 85% of segmented polyurethane.

Non-elastic strands possess little to no elasticity. Strands formed of hard fibers and strands formed of high tensile strength filaments are examples of non-elastic strands. Hard yarns are yarns that are substantially non-elastic. That is, hard yarns include knitting yarns which possess little to no elastic stretch, such as natural and/or synthetic spun staple yarns, natural and/or synthetic continuous filament yarns, and combinations thereof. Examples of materials that may be utilized in the spun staple and/or continuous filament hard yarns include cotton, polyester, nylon, polypropylene, polyethylene, acrylics, wool, acetate, polyacrylonitrile, and combinations thereof. Natural fibers include cellulosic fibers (e.g., cotton, bamboo) or protein fibers (e.g., wool, silk, and soybean). They also can be of mono component poly(ethylene terephthalate) and poly(trimethylene terephthalate) fiber, polycaprolactam fiber, poly(hexamethylene adipamide) fibers acrylic fibers, modacrylic, acetate fibers, rayon fibers, nylon and combinations thereof.

Referring again to the drawings, and in particular FIGS. 2A-2D, the article of footwear 100 is an athletic shoe (e.g., a running shoe) defining a forefoot region 200A, a midfoot region 200B, and a hindfoot region 200C, as well as a medial side 205A and a lateral side 205B. The forefoot region 200A generally aligns with the ball and toes of the foot, the midfoot region 200B generally aligns with the arch and instep areas of the foot, and the hindfoot region 200C generally aligns with the heel and ankle areas of the foot. Additionally, the medial side 205A is oriented along the medial (big toe) side of the foot, while the lateral side 205B is oriented along the lateral (little toe) side of the foot. While the example embodiment depicted in the figures shows an article of footwear (shoe) configured for a right foot, it is noted that the same or similar features can also be provided for an article of footwear (shoe) configured for a left foot (where such features of the left footed shoe are reflection or "mirror image" symmetrical in relation to the right footed shoe).

The upper 105 includes a first portion and a second portion. The first portion covers the hindfoot, the sides and dorsum of the midfoot, and the planum (bottom facing side) of the entire foot. Accordingly, the first portion includes a heel section 210 that includes heel cup 400 (FIG. 4), a lateral quarter section 215 (oriented on the lateral shoe side 205B), a medial quarter section 220 (oriented on the medial shoe side 205A), and a planum section 300 (FIG. 3) that engages the planum of the foot. The second portion covers the dorsum and sides of the forefoot. The second portion includes a vamp section 225, a toe cage section 230, and an instep cover section 240. With this configuration, the heel section 210, lateral quarter 215, medial quarter 220, vamp 225, toe cage 230 and planum section 300 cooperate to form the cavity 332 (FIGS. 3 and 4) into which a foot is inserted by way of an access opening 235, which is defined by the heel section, the lateral and medial quarters, and the instep cover.

The vamp section 225 can be provided with a configuration that includes a region 287 having a structure that serves as a heat sink for the shoe by affecting moisture, airflow and/or heat transfer for the upper 105 at the region 287. These features are generally achieved by utilizing one or a combination of yarn types knitted at such region 287 that provide poor thermal resistance and effective heat transfer (e.g., providing yarns in region 287 that comprise an ultra high molecular weight polyethylene or UHMWPE polymer component) and/or modifying the knit structure at the surface to enhance heat transfer (e.g., providing undulations at the surface of region 287 as depicted in the drawings, where the undulations comprise knitted beams extending over indentations or channels to create an uneven, wavy and/or undulating exterior surface).

Figure 4:
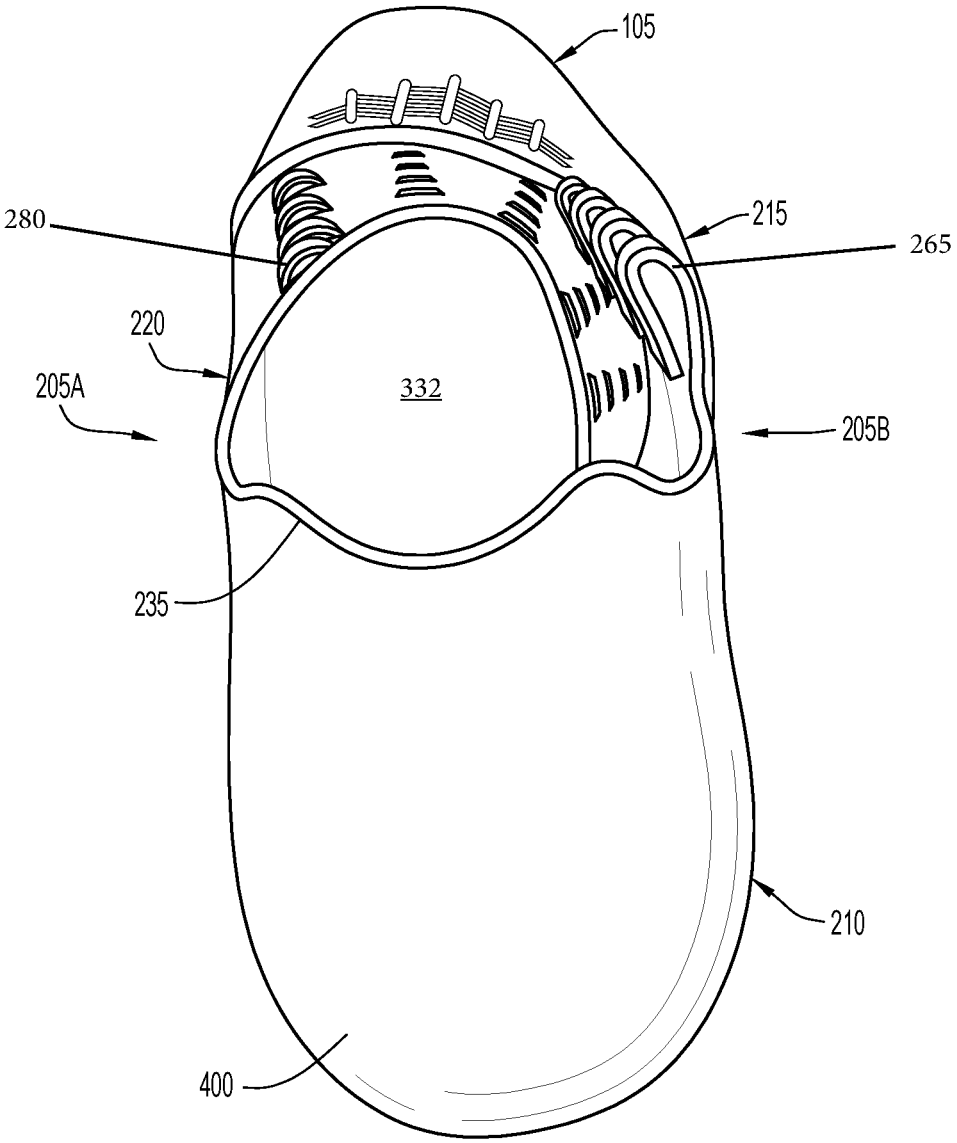
FIG. 4 is an isolated rear view of the upper of the article of footwear of FIG. 1, showing a seamless heel section and a rear view of the adjustable lacing system.

Referring to FIG. 4, the heel section 210 includes a heel cup 400. The heel cup 400 possesses a generally arcuate profile. Specifically, the heel cup 400 is generally dome shaped, curving from a point proximate opening 235 toward the planum section 300, as well as curving from the lateral quarter 215 to the medial quarter 220 (and vice versa). Similarly, the lateral quarter section 215 and the medial quarter section 220 seamlessly couple with the planum section 300. The heel section 210 can be a seamless, stitchless structure that results from knitting a unitary structure that forms the upper. Alternatively, the heel section 210 can include any one or more seams that result from securing two or more portions of the upper together in any suitable manner to form the heel section.

The lateral quarter 215 extends upward from the planum section 300 such that the lateral quarter spans the lateral side of the foot, at least in the hindfoot and midfoot areas. As described herein, the lateral quarter 215 includes portions of the lacing system configured to receive and retain the fastener 120 with the upper 105.

Figure 3:
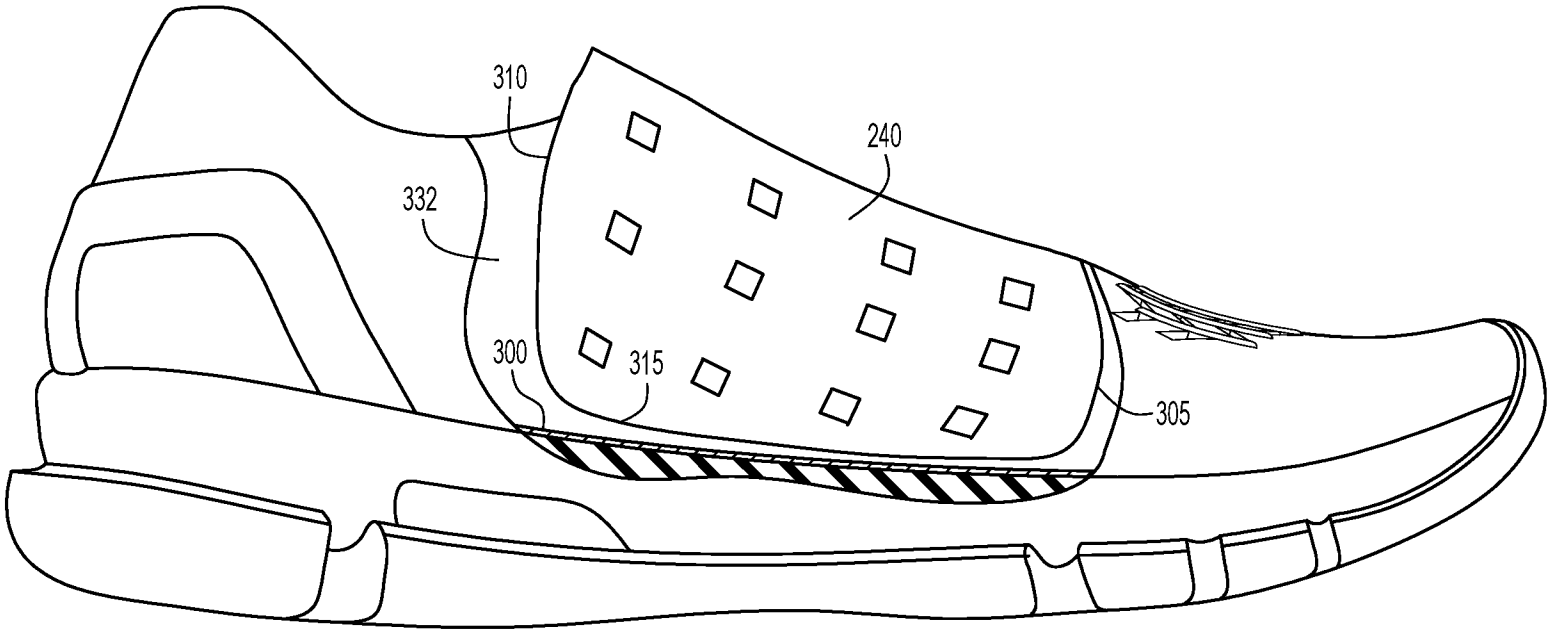
FIG. 3 is a side view in elevation of the article of footwear shown in FIG. 1, showing the lateral footwear side and further including a partial cut-out section.

The medial quarter 220 extends upward from the planum section 300 such that the medial quarter spans the medial side of the foot, at least in the hindfoot and midfoot areas. In the illustrated embodiment, the medial quarter 220 extends from the heel section 210 to the vamp section 225. An instep cover 240 may be formed integrally with the medial quarter 220 such that the instep cover spans the dorsum of the midfoot (i.e., the instep). Referring to FIG. 3, instep cover 240 defines a forward edge 305, a rearward edge 310 oriented generally parallel to the forward edge. The instep cover 240 further defines distal edge 315 oriented generally orthogonal to the forward and rearward edges. The instep cover 240 generally spans the instep of the foot, extending from the medial shoe side 205A to the lateral shoe side 205B, and extending from the vamp 225 at its forward edge 305 to the access opening 235 at its rearward edge 310. As noted above, the access opening 235 is partially defined by the rearward edge 310. The width of the instep cover 240 (i.e., the dimension of the instep cover that is transverse its longitudinal or lengthwise dimension can be generally uniform. Alternatively, the width of the instep cover 240 can change in dimension, e.g., where one or both of the forward edge 305 and rearward edge 310 tapers in a direction extending from the distal edge 315 to the medial quarter 220 such that the width of the instep cover 240 varies (e.g., the width of the instep cover 240 is greatest at the distal edge 315).

The length of the instep cover 240 (i.e., the length in the transverse (width) dimension of the shoe 100), is selected such that a distal portion of the instep cover 240 overlaps the lateral quarter 215. For example, when the shoe 100 is placed on the foot of the wearer, distal edge 315 of the instep cover 240 is oriented within the cavity 332, being positioned below the lateral quarter 215 (e.g., proximate the planum section 300). The forward edge 305 of the instep cover 240 may be secured to the vamp 225 along seam 250 (FIG. 2A), e.g., via stitching, adhesive, etc. In an embodiment, only a portion of the forward edge 305 is secured to the vamp 225 via a vamp seam 250. The distal portion of the instep cover forward edge 305 (i.e., the area of the forward edge proximate the distal edge 315), as well as the instep cover distal edge 315, may be unsecured to permit repositioning relative to the lateral quarter 215. By way of example, about 50% to about 75% of the instep cover forward edge 305 may be secured to the vamp 225 along vamp seam 250. In other embodiments, the entire forward edge 305 is secured.

While the instep cover 240 has been described herein and depicted in the drawings as being an integral portion or extension of the medial quarter 220 that overlaps the lateral quarter 215, it is noted that alternative embodiments may also be provided in which the instep cover is instead integral with and is an extension of the lateral quarter such that it overlaps the medial quarter of the upper (i.e., a reverse of the configuration described herein). It is to be understood that, in such embodiments, the lacing system 112 as described herein can also have a correspondingly reversed configuration.

The sole structure 110 comprises a durable, wear-resistant component configured to provide cushioning as the shoe 100 impacts the ground. In certain embodiments, the sole structure 110 may include a midsole and an outsole. In additional embodiments, the sole structure 110 can further include an insole that is disposed between the midsole and the upper 105 when the shoe 100 is assembled. In other embodiments, the sole structure 110 may be a unitary and/or one-piece structure. As can be seen, e.g., in the exploded view of FIG. 1, the sole structure 110 includes an upper facing side 125 and an opposing, ground-facing side 130. The upper facing side 125 may include a generally planar surface and a curved rim or wall that defines the sole perimeter for contacting the bottom surface 135 of the upper 105. The ground-facing side 130 of the sole structure 110 can also define a generally planar surface and can further be textured and/or include ground-engaging or traction elements (e.g., as part of the outsole of the sole structure) to enhance traction of the shoe 100 on different types of terrains and depending upon a particular purpose in which the shoe is to be implemented. The ground-facing side 130 of the sole structure 110 can also include one or more recesses formed therein, such as indentations or grooves extending in a lengthwise direction of the sole structure 110 and/or transverse the lengthwise direction of the sole structure, where the recesses can provide a number of enhanced properties for the sole structure (e.g., flexure/pivotal bending along grooves to enhance flexibility of the sole structure during use).

The sole structure 110 may be formed of a single material or may be formed of a plurality of materials. In example embodiments in which the sole structure includes a midsole and an outsole, the midsole may be formed of one or more materials including, without limitation, ethylene vinyl acetate (EVA), an EVA blended with one or more of an EVA modifier, a polyolefin block copolymer, and a triblock copolymer, and a polyether block amide (e.g., a PEBAX® material). The outsole may be formed of one or more materials including, without limitation, elastomers (e.g., thermoplastic polyurethane), siloxanes, natural rubber, and synthetic rubber.

The article of footwear 100 can also include a heel counter 115 having a generally curved configuration that corresponds with the heel section 210 of the upper 115 so as to surround a portion of the heel section. In an embodiment, the heel counter 115 includes a central member mounted with the sole structure 110 at a region corresponding with the hindfoot region 200C of the shoe 100 and extending distally (upward) from the upper-facing side 125 of the sole structure 110. A pair of arms and extends from the distal portion of the central member. In particular, a first arm extends from the lateral portion of the central member and along the medial shoe side 205A, while a second arm extends from the distal portion of the central member and along a lateral shoe side 205B. Each arm may possess a curved, generally L shaped configuration so as to extend initially from the central member generally horizontally and along a lengthwise dimension and toward the forefoot region 200A of the shoe 100 and then curve vertically downward toward the upper-facing side 125 of the sole structure 110. The heel counter 115 provides external strengthening at this area of the shoe 100. In particular, the heel counter 110 is configured to control and stabilize the user's heal inside the shoe to minimize excessive supination or pronation of the foot. The heel counter 115 can further be flexible, semi-rigid or rigid, and is further configured to provide rear foot stability, preventing injury and prolonging the lifespan of the shoe. The heel counter 115 can be formed of any one or more suitable materials including, without limitation, one or more thermoplastic elastomers such as EVA or TPU (thermoplastic polyurethane). The upper 105 can be coupled to heel counter 115 in any suitable manner including, without limitation, via an adhesive, via welding (e.g., ultrasonic welding), etc.

Figure 2A:
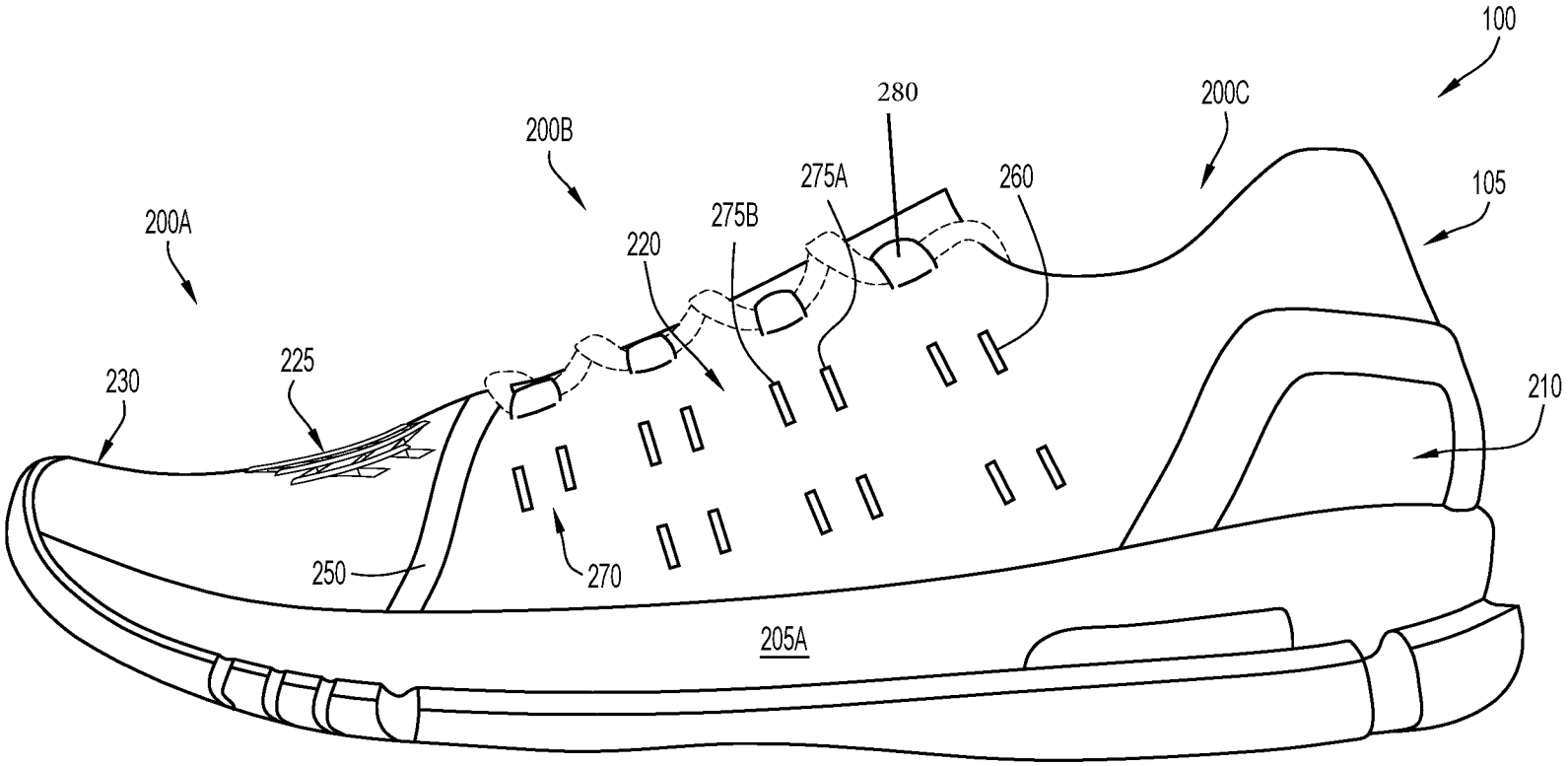
FIG. 2A is side view in elevation of the article of footwear shown in FIG. 1, showing the medial footwear side.
Figure 2B:
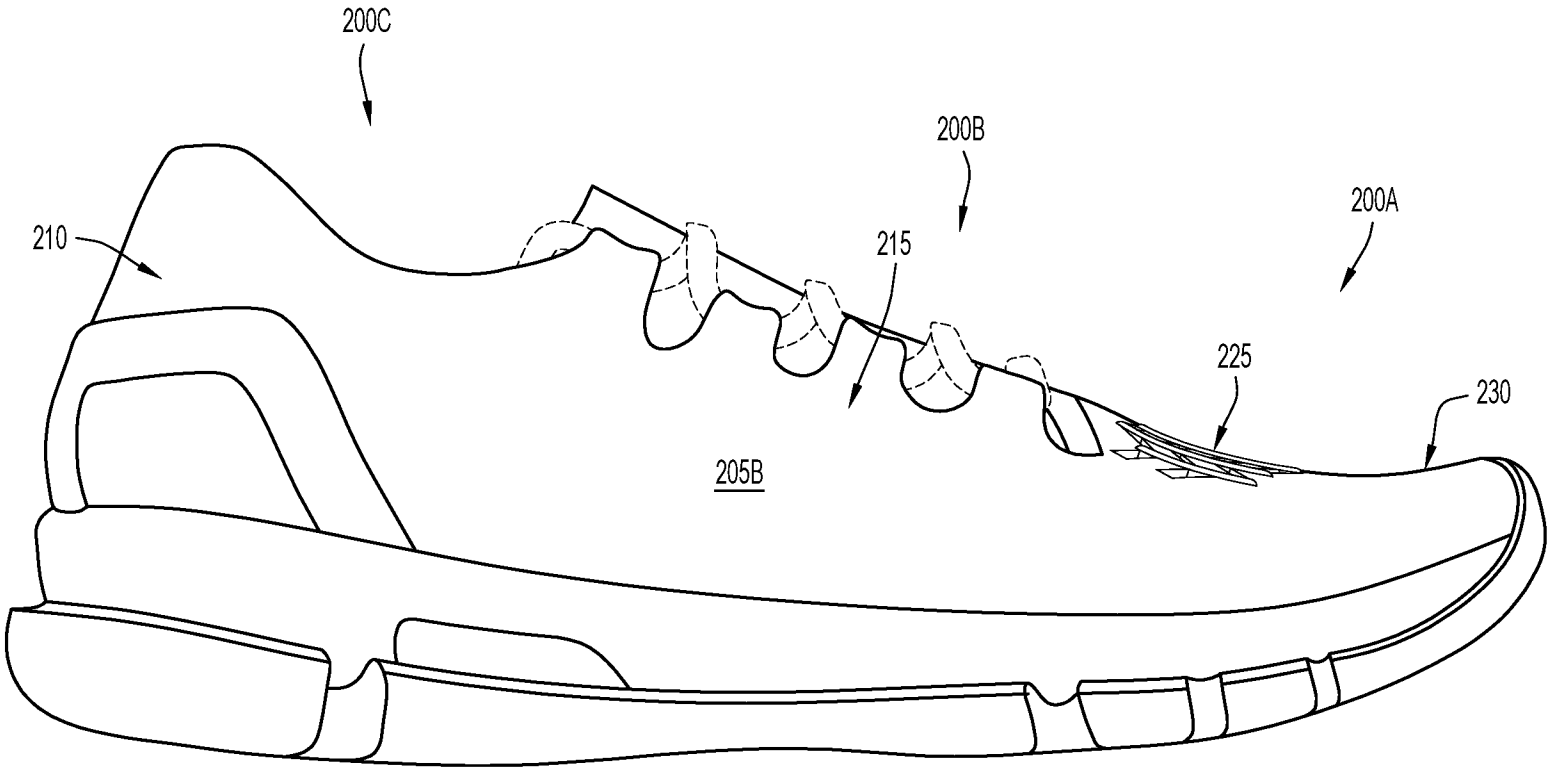
FIG. 2B is a side view in elevation of the article of footwear shown in FIG. 1, showing the lateral footwear side.
Figure 2C:
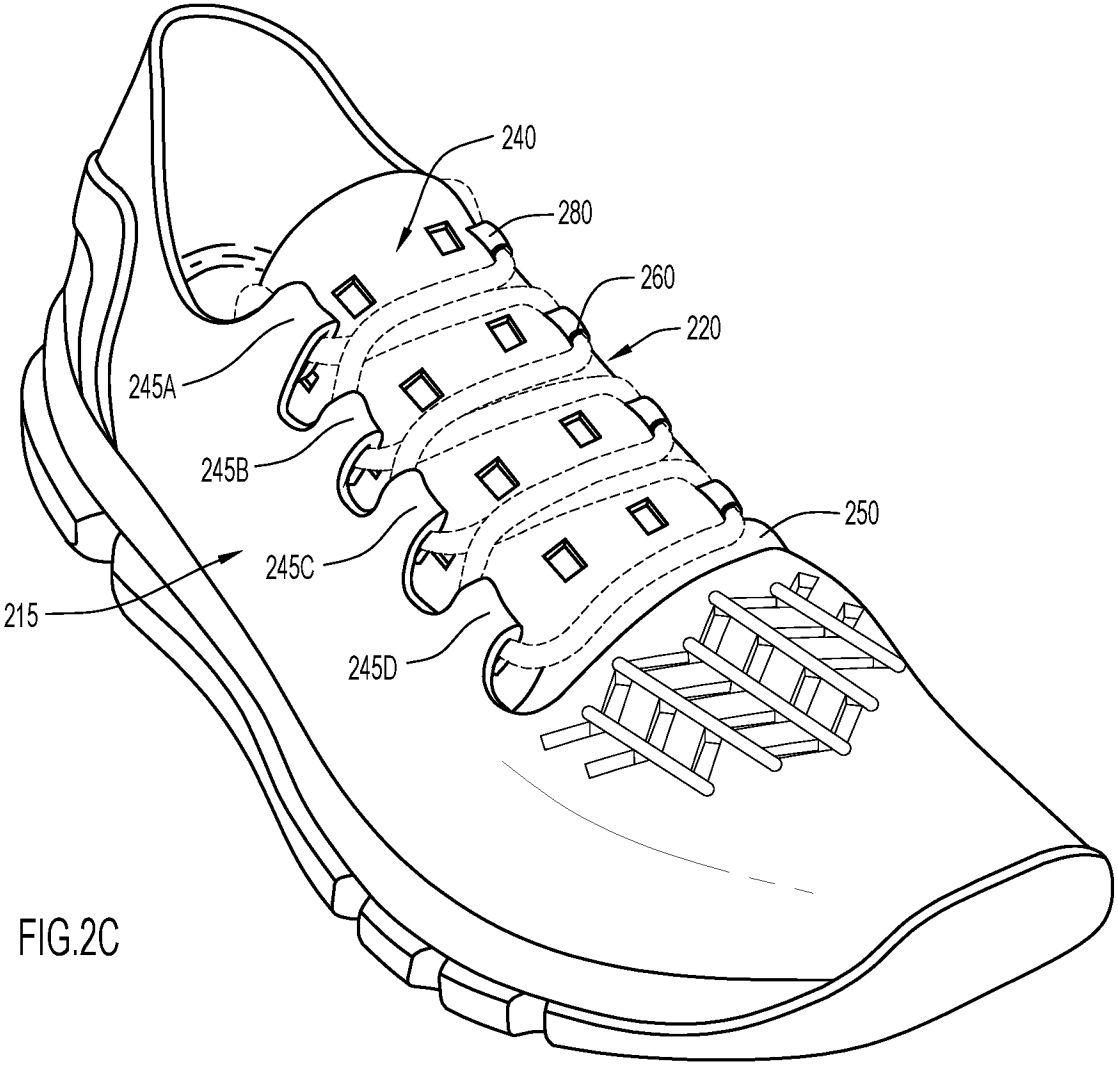
FIG. 2C is a front perspective view of the article of footwear of FIG. 1, showing the lateral footwear side (footwear configured for a right foot).
Figure 2D:
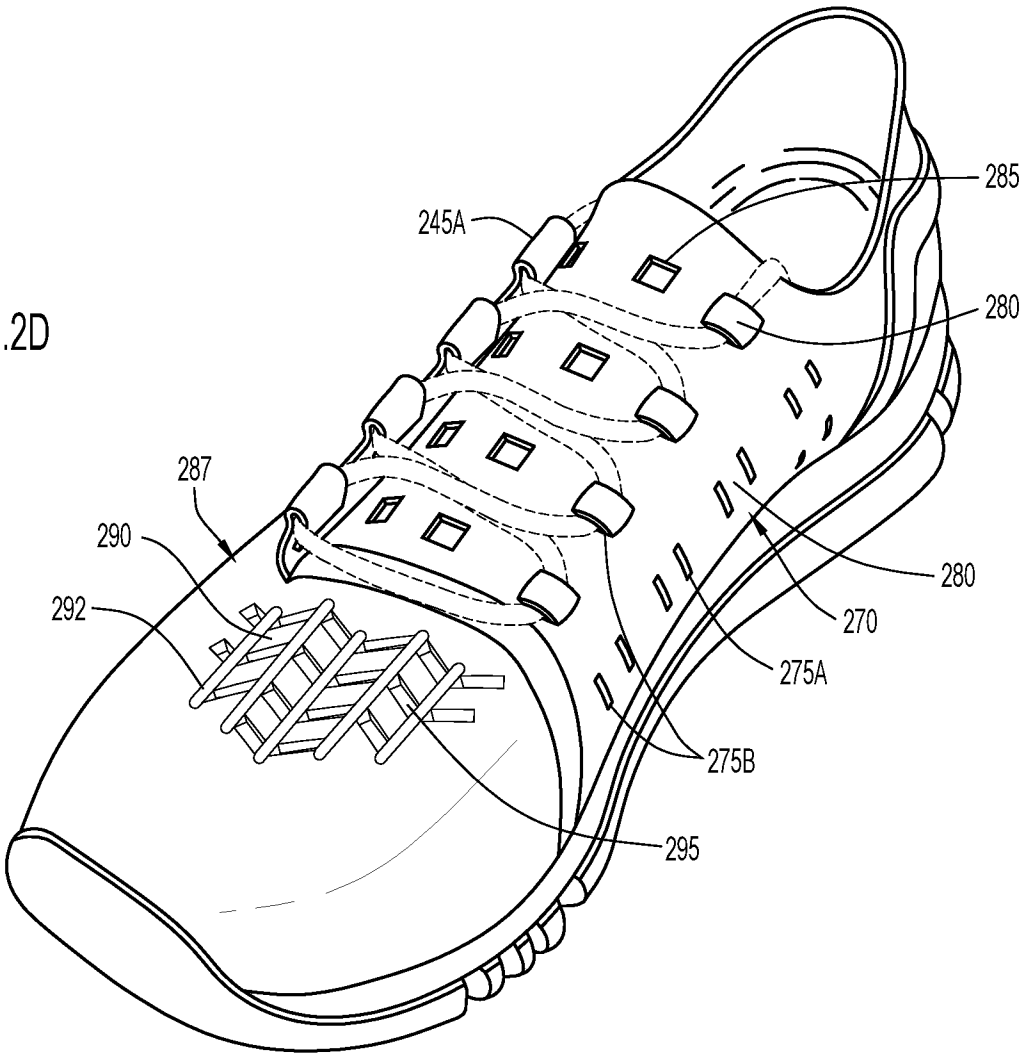
FIG. 2D is a front perspective view of the article of footwear shown in FIG. 1, showing the medial footwear side.
Figure 2E:
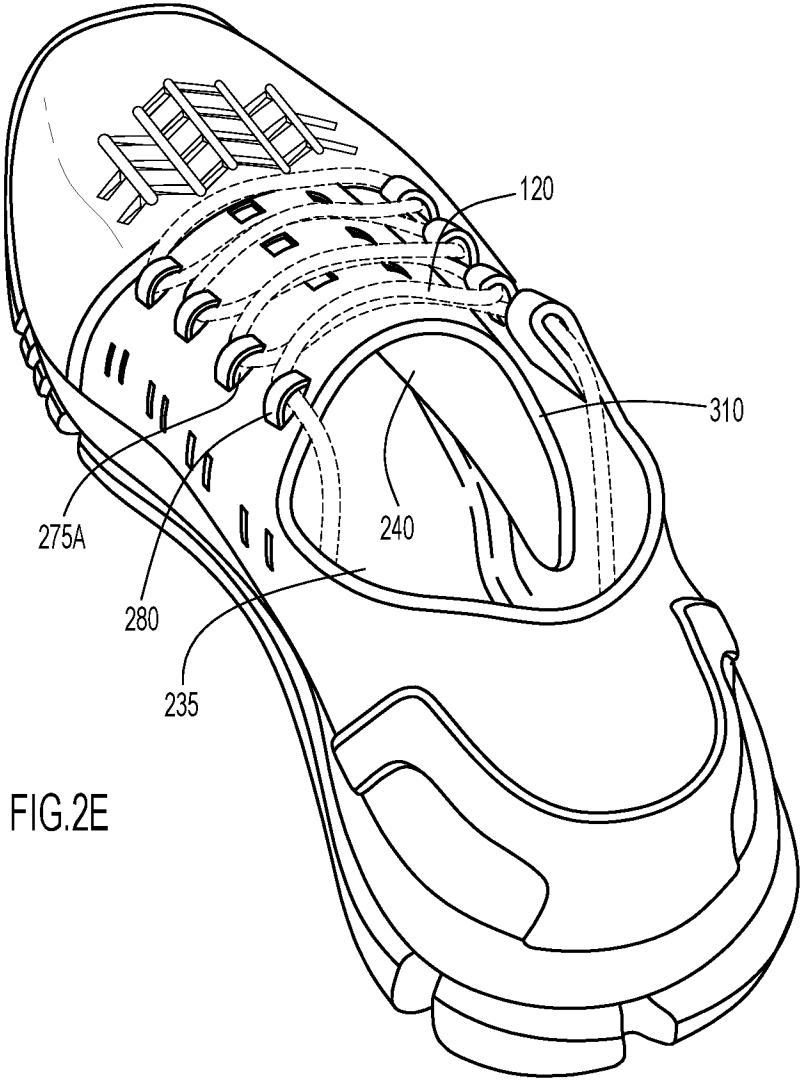
FIG. 2E is a rear perspective view of the article of footwear shown in FIG. 1, showing the medial footwear side.

The lacing system 112 for the footwear is integrated into the upper 105 and includes fastener engaging members or elements that are disposed on both the medial and lateral sides of the upper. In particular, the lacing system 112 includes fastener engaging elements disposed at the lateral quarter 215 for engaging the fastener 120. Referring to FIG. 2C, the lateral quarter 215 includes fastener engaging elements in the form of one or more looped sections or tabs operable to receive the fastener. Specifically, the lateral quarter 215 includes a plurality of looped sections 245A, 245B, 245C, 245D disposed at the lateral quarter distal edge (upper edge). Each of the looped sections 245A-245D includes a strip of material or linear segment extending from the distal edge of the lateral quarter 215. The strip of material is folded over and secured back upon itself (e.g., via stitching, adhesive, etc.) to form a loop defining an opening operable to permit passage of a fastener (e.g., shoe lace or cord) through the loop. As illustrated, the looped sections 245A-245D are linearly spaced, being generally aligned in an array extending in the longitudinal or lengthwise direction of the shoe 100. In this manner, each looped section 245A-245D is configured to receive the fastener 120 (the shoe lace), movably capturing the fastener therein. As described herein, the looped sections 245A-245D, moreover, cooperate with one or more fastener engaging elements disposed on the instep cover to engage the fastener 120 and secure the shoe 100 to the foot of the wearer. Further, as depicted in the drawings, the loops 245 formed on the lateral quarter 215 extend in a direction generally continuous and coplanar with the lateral side 205B, where the loops 245 extend upward and away from the sole structure 110. In particular, the exterior surface of the loops 245 is generally continuous or coplanar with the exterior surface of the lateral side 205B (since the loops are integral with the lateral side).

It is further noted that any other suitable type of fastener engaging members can be provided as an alternative for the looped sections 245 described herein. For example, the lateral quarter 215 can alternatively be provided with any suitable plurality of openings (e.g., sockets or eyelets, cutout sections, etc.) that are configured as part of the lacing system to receive the fastener 120 in a suitable manner that facilitates lacing of the fastener for the upper 105. Alternatively, the looped sections can be separate elements that are secured to the upper in any suitable manner (e.g., via an adhesive, via stitching, etc.).

The lacing system 112 also includes fastener engaging members or elements that are disposed on the medial side and/or top side of the instep cover. For example, the instep cover 240 may include one or more fastener engaging elements in the form of narrow, elongated openings or slots 260 operable to permit passage of the fastener through the openings. As depicted, e.g., in FIGS. 5A and 5B, the instep cover 240 includes a first set 265A of slots, a second set 265B of slots, and a third set 265C of slots. The slots 260 forming a set 265 (e.g., sets 265A, 265B and 265C) are generally aligned in a linear row extending along a lengthwise direction of the upper 105. The slot sets 265A-265C are also laterally spaced across the instep cover 240, with each set running generally parallel to an adjacent set.

Each slot set 265 includes a plurality of slots 260 extending in a generally linear array along the lengthwise dimension (i.e., a dimension that extends between the toe cage 230 and heel section 210) of the upper 105. The slots 260 within a set 265 may be arranged in a series of slot pairs 270 including a first slot 275A adjacent a second slot 275B. These two adjacent slots 275A, 275B are closer in proximity to each other compared to the next closest slot 260 neighboring the pair 270 along the linear array. The region between each slot 260 within a slot pair 270 (i.e., the section of the upper 105 between the slots 260 of a pair 270) defines a material loop 280 along the instep cover 240 when the fastener 120 is guided or "threaded" between the pair of slots 260. With this configuration, each slot pair 270 defines an engagement location or connection point for the fastener 120. Specifically, the fastener 120 may be inserted through a first slot 275A of a slot pair 270 such that it enters the cavity 332, travels along the interior surface of the instep cover 240, and then exits the cavity via the second slot 275B. When the fastener is engaged within the loop 280, the loop 280 extends transversely from the surface portions of the instep cover 240/medial quarter 220 surrounding the loop. The loop 280 further applies a downward (toward the cavity 332) force onto the fastener 120, frictionally securing the fastener in place.

As illustrated (e.g., in FIGS. 5A and 5B), each successive slot set 265A, 265B, 265C is oriented further toward the medial shoe side 205A (toward the medial quarter 220) in relation to the previous slot set. Each slot pair 270 is further aligned with a corresponding looped section 245A-245D so as to facilitate lacing of a fastener 120 (shoe lace) in a serpentine, alternating or zig-zag pattern between looped sections 245A-245D and loops 280 as the fastener 120 extends in a back-and-forth manner between the medial and lateral sides of the upper in order to tighten or loosen the lateral, medial, and/or midfoot regions of the shoe 100 to conform in a desired manner against a user's foot.

As described above, the lacing system 112 of the shoe 100 includes a first lacing structure with fastener engaging elements on the lateral quarter 215 of the upper 105 and a second lacing structure with fastener engaging elements on the instep cover 240/medial quarter 220 of the upper 105. Specifically, the looped sections 245A-245D maintain the fastener 120 on the shoe exterior (outside the cavity 332), while the slot sets 265A-265C permit the fastener into shoe interior (into cavity). Further, the looped sections 245 extend in a continuous and/or coplanar manner from the exterior surface of the upper (i.e., at the lateral quarter 215) while the loops 280 defined between pairs of slots 260 of the slot sets 265 extend transversely from the exterior surface of the upper (i.e., at the instep cover 240/medial quarter 220) or curve outward from the cavity of the upper. Thus, the lacing system for the shoe 100 includes different lacing structure with different fastener engaging elements at each of its lateral side 205B and medial side 205A that facilitate lacing of the fastener (shoe lace) for the shoe.

In addition, providing a plurality of slot sets 265A-265C, where the slot sets are spaced from each other in directions transverse the lengthwise dimension of the upper (i.e., increasing in direction toward the medial quarter 220 and/or lateral quarter 215 of the upper 105), facilitates different locations for lacing the fastener 120 along the instep cover 240 and through the loops 280 formed by slot pairs 270 and proximate the medial quarter 220 (i.e., opposite the lateral quarter 215 including looped sections 245A-245D). To describe this feature in another manner, each successive slot set 265A, 265B, 265C (which extends further in direction toward the medial side) extends further in distance from the corresponding looped sections 245A-245D, where the selection of a slot set 265 through which to lace the fastener provides adjustability for the lacing system 112 to provide a looser or a tighter fit of the instep cover 240 and/or other portions of the upper 105 around the girth or width of the wearer's foot.

Figure 5A:
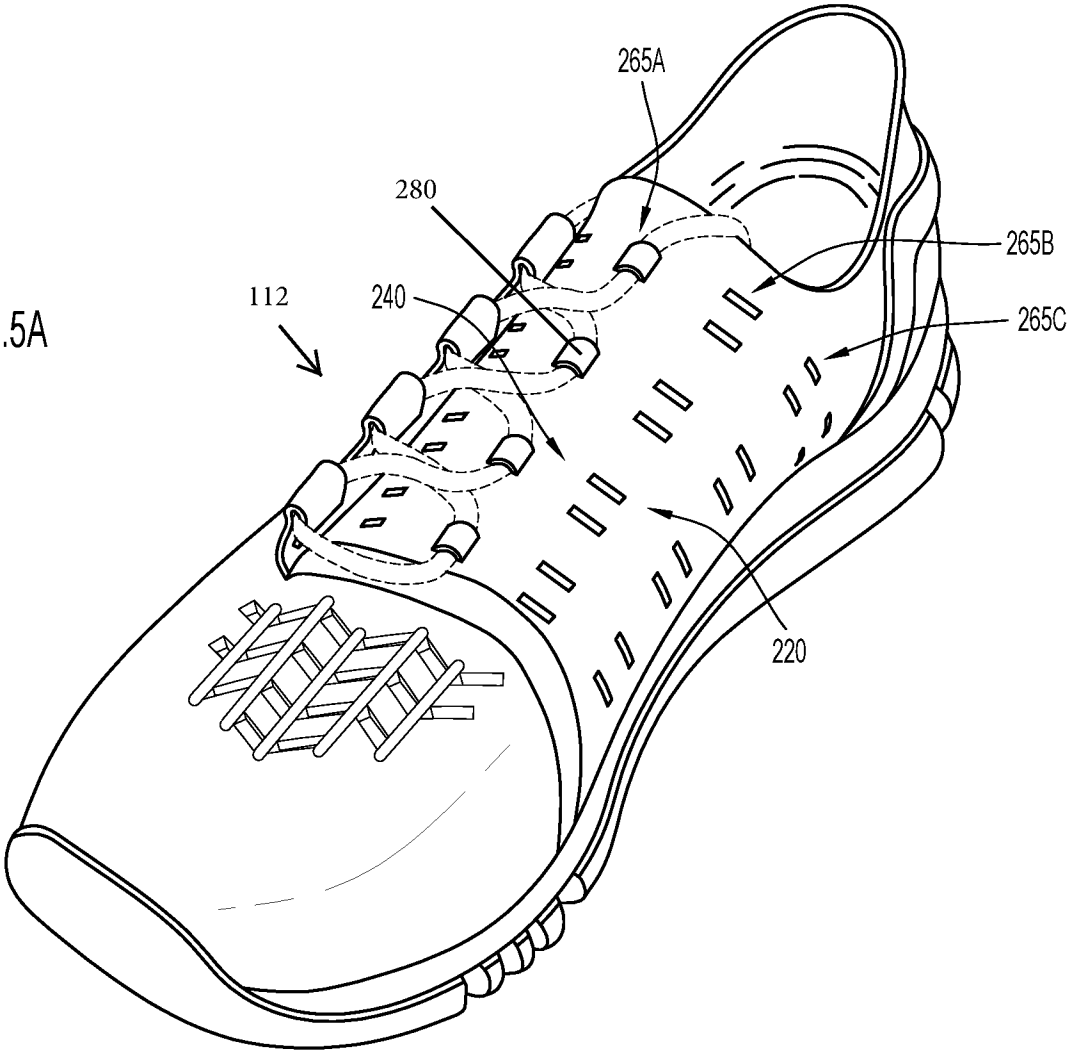
FIGS. 5A and 5B are front perspective views of an article of footwear in accordance with another embodiment of the invention, showing the orientation of a lace at a first medial position (FIG. 5A) and a second medial position (FIG. 5B).
Figure 5B:
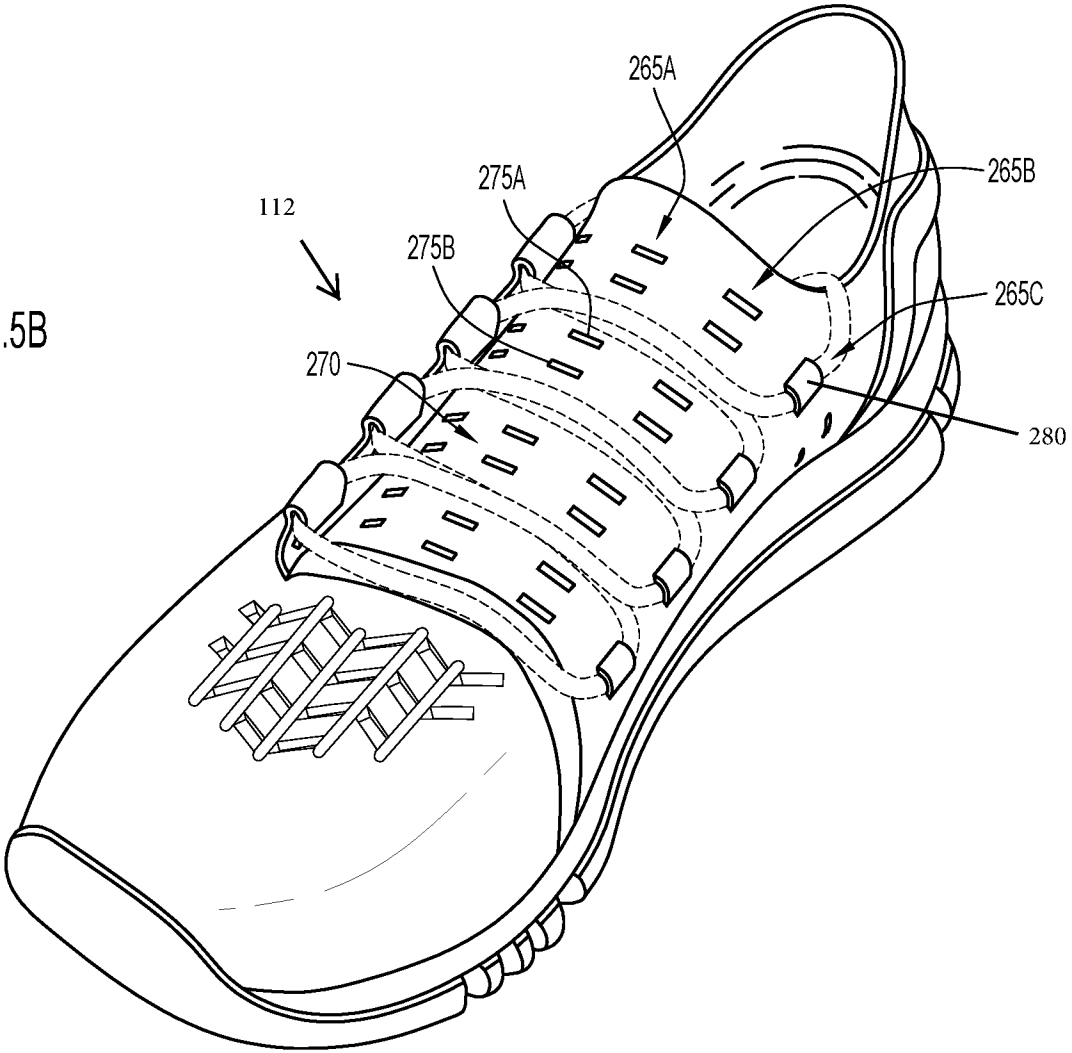

Referring to FIGS. 5A and 5B, the fastener 120 may extend through looped sections 245A-245D and the first slot set 265A (FIG. 5A). Alternatively, the fastener 120 extends from looped sections 245A-245D to the third slot set 265C (FIG. 5B). Selection of a set 265 (e.g., set 265A, 265B or 265C) closer to/further away from the looped sections 245A-245D alters the overall fit of the shoe 100 on the foot of the wearer. In addition, it provides an adjustable fit depending on the girth of the foot as well as user preference. For example, with a large girth or wide foot, the more medially positioned sets 265B, 265C may be utilized to accommodate fit. Alternatively, for a small girth or narrower foot, set 265A might be utilized. The set 265 selected will alter the extent to which the instep cover 240 and the lateral quarter 215 overlap, providing a more- or less-compressive fit. In this manner, these further sets of slots 260 facilitate lacing of a fastener 120 through loops 280 and at different locations along the instep cover 240. Further, due to the ability of the instep cover 240 to be further moved within the cavity 332 and provide an adjustable overlap between instep cover 240 and lateral quarter 215, the adjustability of the lacing system 112 (by selecting different slot sets to lace the fastener) can be implemented to adjust the fit of the upper against the wearer's foot while maintaining a generally symmetrical positioning of the fastener 120 on the lateral and medial sides of the shoe.

In addition to providing fastener engaging elements for the lacing system, the slots may also provide additional functionality for the shoe. For example, the slots may enable flexing within the upper 105 (e.g., without excessive bunching), the slots may provide additional ventilation and air exchange (to help keep the foot cool) and/or the slots may be provided for aesthetic purposes.

The instep cover 240 can also include additional openings or windows 285 operable to improve airflow into/out of the upper. These openings 285 may possess any dimensions suitable for their described purpose. In general, the openings possess larger dimensions in relation to the slots 260. The openings 285, moreover, may be disposed at any location suitable for their described purpose. In the illustrated embodiment, the openings 285 are disposed at locations that are closer to the lateral side 205B of the shoe 100 in relation to the slots 260. The slots 260 and openings 285 may cooperate to enhance ventilation through the upper 105 during use of the shoe 100. As with the upper, the openings 285 may serve a variety of other functions. For example, the slots may enable flexing within the upper 105 (e.g., without excessive bunching) or may be provided for aesthetic purposes.

In addition, while not shown in the embodiments in the figures, the lateral quarter 215 of the upper 105 (i.e., at the lateral side 205B of the shoe 100) can also include slots 260, openings 285, and/or any other form of apertures to enhance ventilation through the upper during use of the shoe 100.

As previously noted, the upper 105 can be formed as a single, unitary member and utilizing a knitting process (e.g., a weft knitting process), where one or more strands run crosswise to form loops in one or more courses of the textile material. A flat knitting process (e.g., a Jacquard flat knitting process) can be utilized to form the textile material represented as the unitary member, where the flat knitting process produces a knitted material that has three-dimensional (e.g., curved) portions (e.g., the toe cage and heel section portions of the upper) and flat portions (all other portions of the upper). The upper 105 can initially be formed as a template or blank including generally flat or planar sections (e.g., including some or all of the portions forming the planum section 300, the medial quarter 220 with instep cover 240, and the lateral quarter 215 with linear segments or strips which form the looped sections 245A-245D) as well as non-planar or curved sections (e.g., three-dimensional section), including some or all of the portions forming the heel cup 400 and/or toe cage 230). The upper 105 is assembled from the template by folding certain portions over toward other portions and then securing such portions together (e.g., via stitching, adhesive, or any other suitable securing manner). The looped sections 245A-245D can be formed by folding over linear segments of the template and securing (e.g., via stitching, adhesive or any other suitable securing manner) the free edges to the upper. The resulting structure may then be heated (via steam) to shrink and/or set and/or fuse strands within the textile structure. Once set, the upper 105 may be secured to the sole structure 110 via, e.g., adhesive.

The types of strands provided at various locations of the knitted upper can be varied to impart different properties at such locations such as varying elasticity/stretching properties, different thermal/heat transfer properties, different tear resistance/material strength properties, etc. As previously noted, that vamp section can be provided with a region 287 that is formed with yarns comprising one or more polymers having poor thermal resistance properties (so as to facilitate transfer of heat from the shoe at region 287).

The instep cover 240 and/or other portions of the medial quarter 240 or upper can also be formed with strands and/or yarns comprising polymers have a sufficient elasticity (e.g., strands and/or yarns formed from elastane) to facilitate stretching of the instep cover 240 and medial quarter 220 in a direction toward the lateral quarter 215 when the fastener structure (e.g., shoe lace) is threaded through different sets of slots 260 (e.g., through set 265A, 265B or 265C, such as depicted in FIGS. 5A and 5B). For example, the instep cover 240, medial quarter 240 and/or other portions of the medial side 205A can be formed from a material (e.g., strands and/or yarns) having a degree of elasticity that is greater (i.e., more elastic or more stretchable) than at least one other portion of the upper 105. In another example, the instep cover 240, medial quarter 240 and/or other portions of the medial side 205A can be formed from a material (e.g., strands and/or yarns) having a degree of elasticity that is greater (i.e., more elastic or more stretchable) than any other portion of the upper 105.

Assembly of the shoe 100 can be performed by initially forming the unitary member, e.g., via a flat knitting process as previously described herein. The slots 260 and openings 285 can be formed as voids in the knitting process and/or by removing material after the knitting process (i.e., forming cut-outs in the unitary member after it is formed). The upper 105 is then formed by folding over the portion of the unitary member defining the second portion (the vamp 225 and toe cage 230) is folded over the first portion (i.e., over the planum section 300) and secured (e.g., via stitching, an adhesive or any other suitable securing manner) to one or more free edge portions defined at the toe cage 230 with a free edge portion defining a front of the planum section 300 and a forward edge 305 of the instep cover 240 that is adjacent the rear edge of vamp 225.

The loop sections 245A-245D are formed by folding over linear segments that extend from the portion of the unitary member defining the lateral quarter 215 and securing (e.g., via stitching, adhesive or any other suitable securing manner) each linear segment at its free edge (defining a seam at such connection). The resultant textile upper 105 may then be heat treated to impart fusing to any fusing strands and/or yarns with adjacent yarns in the upper. A suitable heat treatment process such as treatment (e.g., with heated air, steam, etc.) can be implemented to achieve a suitable temperature (e.g., at least about 90° C., generally between about 85° C.-120° C.) at which the fusing strands sufficiently melt to obtain a fused surface area for the upper 105. For example, the textile upper 105 can be subjected to steam at a temperature from about 90° C. to about 120° C. (e.g., about 100° C.) to achieve sufficient melting of the fusing polymer components and sufficient fusion between strands and/or yarns within the upper 105.

The upper 105 including fused area(s) can be coupled with the heel counter 115 and sole structure 110 in any suitable manner as previously described herein. Alternatively, the upper 105 can be coupled with the heel counter 115 and sole structure 110 and then subsequently subjected to heat treatment to form the fused area(s) for the upper.

The upper 105 formed in this manner from a unitary member 700 defines a shell that encloses a foot inserted within the upper (e.g., in a manner similar to a sock). As described herein, the upper 105 includes an instep cover 240 that is integral (i.e., seamless) with the medial quarter 220, where the instep cover extends to a free end 315 such that the instep cover is generally configured as a flap which partially folds within the cavity 332 of the upper 105 and with the free end 315 being proximate or adjacent an interior surface portion of the lateral quarter 215 when the shoe 100 is worn by a user. The upper 105 can also be configured such that there is a variable amount or degree at which the free end 315 may extend within the cavity 332 of the upper 105, which correspondingly enhances the fit of the upper 105 against the user's foot when utilizing the lacing system 112 in the manner described herein. The fastener 120 (e.g., a lace) can be utilized to maintain the instep cover 240 at a particular degree or amount of fold within the upper cavity or overlap relative to the lateral quarter 215 (i.e., maintaining the distance that the free end 315 of the instep cover 240 is inserted within the cavity 332) so as to adjust the shoe fit to be tighter or more loose for a user as desired. As previously noted, a shoe lace can be laced through loops 280 provided between different sets of slots 265A-265C located medially (i.e., located closer toward the medial shoe side 205A) or laterally (i.e., located closer to the lateral shoe side 205B) in relation to other sets of slots 265A-265C so as to adjust the amount or degree of distance at which the free end 315 of the instep cover 240 folds within the cavity 332 of the upper 105.

Thus, the lacing system of the present invention permits insertion of the instep cover into the cavity 332 and below the lateral quarter 215. As previously described, the lacing system includes a first connection configuration that movably captures the fastener, positioning it along the exterior of the upper 105 and the exterior of the upper cavity 332, and a second connection configuration that movably captures the fastener, positioning at least a portion of the fastener within the upper interior (i.e., within the cavity 332). In other words, a portion of the fastener structure engaged by each of the fastener engaging elements of the first connection configuration is disposed between an interior surface portion of the upper and the cavity defined by the upper, and a portion of the fastener structure engaged by each of the fastener engaging elements of the second connection configuration is disposed external to the cavity defined by the upper. The first system includes a plurality of loops, each loop generally aligning with a corresponding slot pair. The second configuration may further include a plurality of slot pair sets aligned in the transverse dimension of the shoe 100, where each slot pair is effective to capture the fastener. Accordingly, the fastener is selectively secured a predetermined distance from a loop. Thus, the adjustable lacing system provides an adaptable fit, permitting users with differing feet girths to thread the fastener through the proper row of slots to alter the cavity diameter within the instep area of the foot.

While the embodiments described herein depict an adjustable lacing system in which a first type of fastener engaging elements in the form of loops are provided on the lateral side of the shoe and a second type of fastener element different from the first type and in the form of pairs of slots are provided on the medial side of the shoe, it is noted that the adjustable lacing system of the present invention is not limited to such embodiments but instead can be revised in any suitable manner to achieve the same or similar effect. For example, the first and second types of fastener engaging elements can be reversed in their positions, with the first type (loops) being located on the medial side of the shoe and the second type (pairs of slots) being located on the lateral side of the shoe. In another embodiment, the first and second types of fastener engaging elements can be the same or similar while still allowing adjustability. For example, each of the first and second types of fastener engaging elements can comprise pairs of slots, where the fastener (e.g., shoe lace) can be selectively inserted or "threaded" through different sets of slot pairs on either or both the medial and lateral sides of the shoe. The adjustable lacing system can further be configured to accommodate a plurality of fasteners of the same or varying types (e.g., two or more shoe laces, two or more button type fasteners, any combinations thereof, etc.) that selectively engage with fastener engaging elements in any suitable manner.

The lacing system of the present invention is particularly suitable for an embodiment including an instep cover that is integral with one side (e.g., lateral or medial side) of the upper such as the embodiment depicted in the drawings, such that adjusting the fastener/lacing structure to engage with different sets of fastener engagement elements that are aligned longitudinally and transverse the longitudinal direction of the shoe results in an effective loosening or tightening of the lateral and medial sides of the upper against the wearer's foot. However, the lacing system can also be implemented in shoes having a different configuration for the upper, such as an upper in which an instep cover (also referred to as a tongue) is not integral with but instead separated from both the lateral and medial sides of the upper. In this configuration, fastener engaging elements can be provided on the lateral and medial sides of the shoe to facilitate adjustable tightening or loosening of the upper against a wearer's foot in a manner similar to that described herein and depicted in the drawings.

While the invention has been described in detail and with reference to specific embodiments thereof, it will be apparent to one skilled in the art that various changes and modifications can be made therein without departing from the spirit and scope thereof.

For example, while knitting has been described herein as an example process for forming the upper, it should be understood that other processes may be used to form structural portions of the upper. By way of specific example, woven and nonwoven processes may be utilized. Within the knit structure, various stitches may be used to provide different areas of the upper with different properties. For example, a first area may be formed of a first stitch configuration, and a second area may be formed of a second stitch configuration that is different from the first stitch configuration to impart varying textures, structures, patterning, and/or other characteristics to the upper member. In addition, Bemis Associates, Inc. of Shirley, Mass., United States manufactures polymer heat seal seam tapes that may be utilized to reinforce seams, replace stitching, and/or prevent fraying. The seam tapes are thermoplastic polymers that may be applied by commercially-available taping machines and join textile sections formed of a variety of materials, such as polyester, cotton, and blended fabrics that include both polyester and cotton fibers.

The lacing system 112 can be configured to engage with a securing structure other than a shoe lace for purposes of loosening or tightening the fit of the upper 105 on the user's foot. For example, in other embodiments, securing structure (e.g., hook and loop fasteners, button/snap fasteners, etc.)

can be provided proximate the free end 315 of the instep cover 240 and also correspondingly along an interior upper surface portion at the lateral quarter 215 to secure the instep cover free end with the lateral quarter.

The lacing system 112 for the upper 105 can include different fastener engaging elements on the lateral and medial sides of the upper (e.g., loops 245 on the lateral side and sets of slots 260 defining loops on the medial side as shown in the drawings). Alternatively, fastener engaging elements of the same or similar types can be provided on both lateral and medial sides. Further, the loops 245 as depicted in the drawings can alternatively be provided on the medial side of the upper 105, while sets of slots 260 are provided on the lateral side of the upper 105.

The instep cover 240 can be integral with and an extension of either the medial quarter 220 (as described herein and depicted in the drawings) or, alternatively, integral with and an extension of the lateral quarter 215 (i.e., a reverse of the configuration described herein).

The loops 245 of the lacing system 112 can be formed in any suitable shapes, dimensions and/or locations along the upper to facilitate engagement with fastener structure. As previously described herein, the loops 245 can be integrally formed as part of the upper (e.g., as part of a unitary knit structure that forms the upper), where elongated segments of the material forming the upper are folded upon each other to define the loops. Alternatively, the loops can also be separate from the material forming the upper, where the loops are secured in any suitable manner to a surface of the upper (e.g., via adhesive, stitching, etc.).

The slots 260 in the various sets 265 used to form loops 280 that engage with the fastener (shoe lace or other fastening structure) can have any suitable sizes and/or shapes and can further be arranged in any suitable orientations and locations along the lateral and/or medial sides of the upper so as to facilitate adjustable engagement of one or more fasteners to control the loosening or tightening of the shoe against the wearer's foot. The openings 285 may also have any suitable sizes, shapes and/or orientations suitable for their intended purpose of providing adequate airflow through the upper 105. In some embodiments, some or all of the openings can be suitably dimensioned, shaped and oriented in pairs to serve as slots 260 capable of defining loops 280 for adjustable engagement with fastening structure as part of the lacing system for the shoe.

The access opening or collar 230 may be finished with any suitable material, e.g., fabric tape applied via adhesive. In an example embodiment, a strip of material is applied around an inside edge of collar 235 to allow the edge of collar to be finished without a binding to reduce fraying and/or to help collar adhere to the skin of the user. The material may be an elastomeric and/or tacky polymer such as, but not limited to, polyurethane, silicone, nylon, and polyester. In another exemplary embodiment as described herein, the collar 235 may be formed of a textile material that is constructed of a composition of yarns or strands that differ from other textile material portions of the upper 105. The remaining portion of the opening to the interior cavity of the upper 105 is defined by an edge 305 of the instep cover 240 that extends from the medial quarter 220 toward the lateral quarter 215 when the instep cover 240 is folded over to fit within the interior cavity 332 of the upper 105 along lateral shoe side 205B as described herein.

As previously described herein, the lacing system can be implemented for a shoe upper that includes a conventional tongue instead of an instep cover 240 (i.e., where the tongue includes a longitudinally extending member free on its lateral and medial sides).

Thus, it is intended that the present invention covers the modifications and variations of this invention provided they come within the scope of the appended claims and their equivalents. It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration.

What is claimed:

1. An article of footwear defining a forefoot region, a hindfoot region, a midfoot region disposed between the forefoot region and the hindfoot region, a lateral side, and a medial side, wherein the lateral and medial sides extend along each of the forefoot region, hindfoot region and midfoot region, the article of footwear including a foot cavity configured to house a foot, the article of footwear comprising:

a sole structure;

an upper coupled to the sole structure, the upper comprising a knit textile formed of a plurality of interlocked strands, the knit textile extending upward from the sole structure to define a proximal quarter section and a distal instep cover formed integrally with the proximal quarter section, the distal instep cover configured to span an instep of the foot, the knit textile further including a lace fastener comprising a first opening separated from a second opening by a knit segment of the knit textile capable of moving from a first, in-plane configuration, in which the knit segment is in plane with a surface of the knit textile, to a second, out-of-plane configuration, in which the knit segment is out of plane with the surface of the knit textile, wherein each of the first opening and the second opening comprises an elongated slot oriented in a direction transverse a lengthwise direction of the upper; and a lace operable to fasten the upper to the foot in the foot cavity, the lace extending over portions of the distal instep cover between the lateral side and the medial side, and the lace further extending over the surface of the knit textile and through each of the first opening and the second opening such that the lace is positioned under the knit segment to orient the knit segment in the second, out-of-plane configuration and the knit segment protrudes from the surface of the knit textile.

2. The article of footwear of claim 1, wherein the knit textile including the proximal quarter section and the distal instep cover is a one-piece knit textile.

3. The article of footwear of claim 2, wherein:

the distal instep cover defines a distal free edge of the one-piece knit textile; and the distal free edge of the one-piece knit textile is positioned within the foot cavity.

4. The article of footwear of claim 3, wherein:

the one-piece knit textile extends from the medial side of the article of footwear to the lateral side of the article of footwear.

5. The article of footwear of claim 2, wherein:

the article of footwear includes a medial quarter and a lateral quarter;

the proximal quarter section of the one-piece knit textile forms the medial quarter of the article of footwear; and the distal instep cover overlaps the lateral quarter of the article of footwear.

6. The article of footwear of claim 2, wherein the lace is positioned under the knit segment and above the plane defined by the surface of the knit textile.

7. The article of footwear of claim 1, wherein the knit textile comprises a plurality of lace fasteners, each lace fastener of the plurality of lace fasteners comprising a first opening separated from a second opening by a knit segment of the knit textile capable of moving from a first, in-plane configuration, in which the knit segment is in plane with the surface of the knit textile, to a second, out of plane configuration, in which the knit segment is out of plane with the surface of the knit textile.

8. The article of footwear of claim 7, wherein the plurality of lace fasteners is generally aligned in a linear row extending along the lengthwise direction of the upper.

9. The article of footwear of claim 8, wherein the plurality of lace fasteners comprises:

a first plurality of lace fasteners located within the proximal quarter section of the knit textile proximate the sole structure; and a second plurality of lace fasteners located within the distal instep cover of the knit textile.

10. A method of fastening the article of footwear of claim 1, the method comprising:

coupling the lace to the article of footwear by passing the lace through each of the first opening and the second opening such that the lace is positioned over the plane defined by the surface of the knit textile and under the knit segment, thereby orienting the knit segment in the second, out-of-plane configuration such that the knit segment protrudes from the surface of the knit textile;

wherein the knit segment fastens the lace to the upper.

11. The method of claim 10, wherein the knit textile including the quarter section and the instep cover is a one-piece knit textile.

12. The method of claim 11, wherein:

the one-piece knit textile extends from the medial side of the article of footwear to the lateral side of the article of footwear.

13. The method of claim 11, wherein:

the instep cover defines a distal free edge of the one-piece knit textile; and the method further comprises positioning the distal free edge of the one-piece knit textile within the foot cavity.

14. The method of claim 11, wherein:

the article of footwear includes a medial quarter and a lateral quarter;

the quarter section of the one-piece knit textile forms the medial quarter of the article of footwear; and the method comprises overlapping the instep cover with the lateral quarter of the article of footwear.

* * * * *